US011280579B2

(12) United States Patent
Hiroshi Dean

(10) Patent No.: US 11,280,579 B2
(45) Date of Patent: Mar. 22, 2022

(54) SELF-DEFENSE KEY HOLDER

(71) Applicant: Peace KEYper, Inc., Poquoson, VA (US)

(72) Inventor: Ryan Andrew Hiroshi Dean, Poquoson, VA (US)

( * ) Notice: Subject to any disclaimer, the term of this patent is extended or adjusted under 35 U.S.C. 154(b) by 324 days.

(21) Appl. No.: 16/505,844

(22) Filed: Jul. 9, 2019

(65) Prior Publication Data

US 2020/0011635 A1 Jan. 9, 2020

Related U.S. Application Data

(60) Provisional application No. 62/695,607, filed on Jul. 9, 2018.

(51) Int. Cl.

| | |
|---|---|
| ***F41B 15/00*** | (2006.01) |
| ***E05B 19/00*** | (2006.01) |
| ***A47G 29/10*** | (2006.01) |

(52) U.S. Cl.

CPC ..... *F41B 15/00* (2013.01); *A47G 29/10* (2013.01); *E05B 19/00* (2013.01); *A47G 2200/08* (2013.01)

(58) Field of Classification Search

CPC ..... F41B 13/00; F41B 15/00; A47G 29/10; A47G 2200/08; E05B 19/00

USPC ..... 70/408, 456 R; 463/47.4, 47.6

See application file for complete search history.

(56) References Cited

U.S. PATENT DOCUMENTS

| | | | | | |
|---|---|---|---|---|---|
| 2,198,484 | A * | 4/1940 | Merkl | E05B 19/22 | 70/395 |
| 3,526,112 | A * | 9/1970 | Herrington | E05B 19/00 | 70/395 |
| 4,637,238 | A * | 1/1987 | Uda | E05B 19/043 | 70/408 |
| 4,826,002 | A * | 5/1989 | Matuura | E05B 19/00 | 206/37.2 |
| 5,435,160 | A * | 7/1995 | Linsalato | E05B 19/22 | 40/330 |
| 5,440,910 | A * | 8/1995 | Florian | A45C 11/324 | 70/408 |
| 5,775,148 | A * | 7/1998 | Layton | E05B 19/00 | 70/393 |
| 5,794,471 | A * | 8/1998 | Rizzo | E05B 19/00 | 70/408 |
| 5,870,917 | A * | 2/1999 | Mahot | E05B 19/22 | 70/408 |

(Continued)

FOREIGN PATENT DOCUMENTS

| | | | | |
|---|---|---|---|---|
| DE | 1919977 A1 * | 5/1970 | ..... | E05B 19/00 |
| DE | 4446556 C1 * | 5/1996 | ..... | E05B 19/00 |
| DE | 102004027182 A1 * | 12/2005 | ..... | E05B 17/103 |

*Primary Examiner* — Suzanne L Barrett

(74) *Attorney, Agent, or Firm* — Enrique A. Monteagudo, Esq.

(57) ABSTRACT

Aspects of the present disclosure generally pertain to an apparatus and method for holding a key for self-defense. Aspects of the present disclosure more specifically are directed toward a self-defense key holder or an apparatus that rapidly converts a key (e.g., house key) into a fighting weapon, for example, for self-defense. The defense key holder may utilize an existing key (e.g., home/office/auto) to replace bulky and often prohibited self-defense aids. This disclosure may be useful for giving a user additional control and force in a variety of motions with a key or other object.

12 Claims, 8 Drawing Sheets

(56) References Cited

U.S. PATENT DOCUMENTS

| | | | | |
|---|---|---|---|---|
| 6,196,036 | B1 * | 3/2001 | Andersen | E05B 17/0058 70/395 |
| 8,776,563 | B1 * | 7/2014 | Jaffe | E05B 75/00 70/456 R |
| 2004/0011100 | A1 * | 1/2004 | Ross | E05B 19/00 70/408 |
| 2007/0056340 | A1 * | 3/2007 | Boyd | E05B 19/04 70/408 |

* cited by examiner

SELF-DEFENSE KEY HOLDER

CROSS-REFERENCE TO RELATED APPLICATION

This application claims priority to U.S. provisional patent application 62/695,607 filed Jul. 9, 2018 entitled SELF-DEFENSE KEY HOLDER, the contents of which are incorporated herein by reference in its entirety.

BACKGROUND OF THE INVENTION

Technical Field

The present disclosure generally pertains to key holders, and is more particularly directed towards a key holder that facilitates a user to use a key as a weapon.

RELATED ART

Personal defense comes in many forms and may be needed in many places. One may find himself in a dangerous situation where there is no one around and must improvise using items that are readily at hand. Frequently, persons carry a set keys on their person when out of the home. Keys are typically made of metal and can make for an improvised weapon when needed. In addition, keys can be a self-defense aid that can be carried where others cannot (e.g., were designation weapons are banned). However, when one fears that their personal safety is at risk, and holds a key between their own fingers as a makeshift self-defense aid, one is often at risk of cutting their own hand in the event they do encounter an attacker and are forced to use the key between their fingers in this way to defend themselves.

U.S. Pat. App. Pub. No. 20120088587 to Zaccari, et al. and published on Apr. 12, 2012, shows a security device and security system. The disclosed security device and system includes a substantially flat body with an opening formed therein. The opening has a predetermined length and a predetermined height such that an elongated end of a key passes through the opening and a head end of the key does not pass through the opening. A user gripping the security device may then use the elongated end of the key extending outward therefrom as a weapon or tool for self-defense. In the heat of the moment, it may be difficult to fiddle this system and may require the user to focus on its assembly rather than the urgency at hand.

The present disclosure is directed toward overcoming known problems and problems discovered by the inventor. Further, the present disclosure addresses these problem while providing a discrete form of self-defense.

SUMMARY OF THE DISCLOSURE

Aspects of the present disclosure generally pertain to an apparatus and method for holding a key for self-defense. Aspects of the present disclosure more specifically are directed toward a self-defense key holder or an apparatus that rapidly converts a key (e.g., house key) into a fighting weapon, for example, for self-defense. The defense key holder may utilize an existing key (e.g., home/office/auto) to replace bulky and often prohibited self-defense aids. This disclosure may be useful for giving a user additional control and force in a variety of motions with a key or other object.

An apparatus for holding a key is disclosed herein, where the key defines a finger gripping plane and an operational axis of rotation within the finger gripping plane, the key having a tip and a back opposite the tip, relative the axis of rotation. The apparatus for holding a key includes a key mount, a user grip, and a pivot couple. The key mount is configured to fixedly attach to the key and to withstand thrusts into a person using the tip of the key without releasing the key, the key mount defining a finger split axis that is within the finger gripping plane and normal to the axis of rotation of the key when the key mount is fixedly attached to the key. The user grip includes a first finger grip, a second finger grip, and a thrust butt, and is configured to be held by a user between at least two fingers and a palm of the user via the first finger grip, the second finger grip, and the thrust butt, respectively. The user grip defines a knuckle axis extending between the first finger grip and the second finger grip, the knuckle axis being normal to the axis of rotation of the key when the key mount is fixedly attached to the key. The pivot couple is fixed to the key mount, and further fixed to the user grip between the first finger grip and the second finger grip. The pivot couple is configured to rotatably couple the key mount and the user grip between a stowed state and a deployed state of the apparatus, where the stowed state is defined by the finger split axis being oriented substantially parallel with the knuckle axis, and the deployed state is defined by the finger split axis being oriented substantially perpendicular to the knuckle axis.

According to one embodiment, a self-defense key holder for a key is disclosed herein, where the key is substantially planar and has an operational axis of rotation, a tip, and a back, the back being opposite the tip relative to the axis of rotation. The self-defense key holder includes a key mount configured to remain fixedly attached to the key while striking a person with the tip of the key, a user grip configured to be gripped by and between at least two fingers of a user and a palm of the user while striking the person with the tip of the key, and a pivot couple fixed to the key mount, and further fixed to the user grip between the first finger grip and the second finger grip, the pivot couple configured to rotatably couple the key mount and the user grip between a stowed state and a deployed state of the apparatus, said stowed state defined by the finger split axis being oriented parallel with the knuckle axis, said deployed state defined by the finger split axis being oriented substantially perpendicular to the knuckle axis.

According to another embodiment, a self-defense key holder for a key is disclosed herein, where the key is substantially planar and having an operational axis of rotation, a tip, and a back, the back being opposite the tip relative to the axis of rotation. The self-defense key holder includes a key mount fixedly attached to the key, an attachment junction configured to couple the apparatus to another item, the attachment junction including a closed loop fixed to the key mount, a user grip configured to be gripped by and between at least two fingers of a user and a palm of the user while striking a person with the tip of the key, and a pivot couple fixed to the key mount, and further fixed to the user grip between the first finger grip and the second finger grip. The pivot couple is configured to rotatably couple the key mount and the user grip between a stowed state and a deployed state of the apparatus, where the stowed state is defined by the finger split axis being oriented parallel with the knuckle axis, and the deployed state is defined by the finger split axis being oriented substantially perpendicular to the knuckle axis.

DETAILED DESCRIPTION

Aspects of the present disclosure generally pertain to a self-defense key holder. Generally, the self-defense key holder is a device or apparatus that rapidly converts a key (e.g., house key) into a fighting weapon, for example, for self-defense. The defense key holder utilizes an existing key (e.g., home/office/auto) as an option to bulky and often prohibited self-defense aids.

Figure 1:
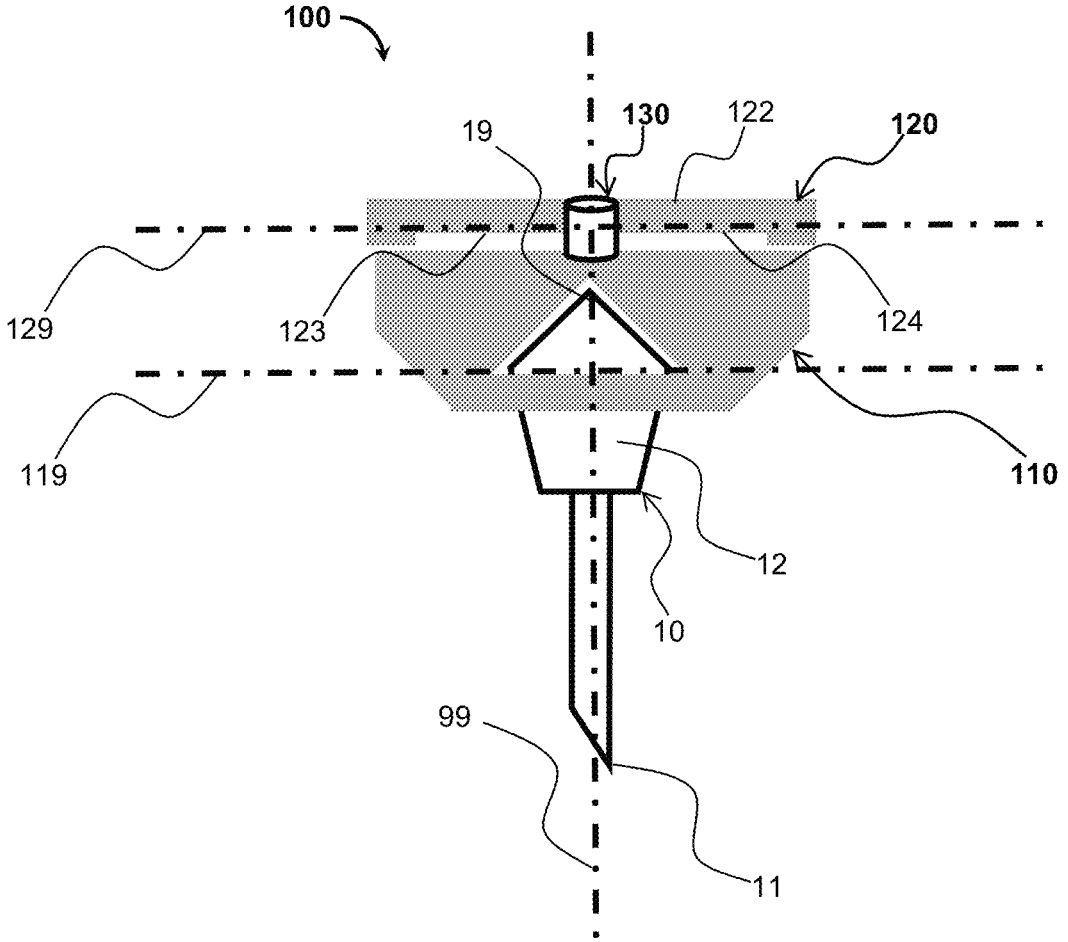
FIG. 1 is a schematic diagram of a self-defense key holder, according to an exemplary embodiment of the present disclosure.

FIG. 1 is a schematic diagram of a self-defense key holder, according to an exemplary embodiment of the present disclosure. In particular, a self-defense key holder or apparatus 100 for holding a key 10 for self-defense ("apparatus 100") is shown, and may include a key mount 110, a user grip 120, and a pivot couple 130. For reference and as shown, the key 10 defines a finger gripping plane 98 (FIG. 2) and an operational axis of rotation 99 within the finger gripping plane 98. The finger gripping plane 98 should be generally understood as being defined by the key's bow 12 or a plane through the bow 12 and between a user's finger and thumb when twisting the key 10. It should also be generally understood the key has a tip 11 and a back 19 opposite the tip 11, relative the axis of rotation 99.

The key mount 110 is configured to fixedly attach to the key 10 and withstand thrusts at a person, for example, using the tip 11 of the key 10. In other words, the key 10 will remain secured to the key mount 110 despite stabbing or otherwise striking an attacker the tip 11 via the apparatus 100. The key mount 110 may conveniently define a finger split axis 119 that is within the finger gripping plane 98 and normal to the axis of rotation 99 of the key 10 when the key mount 110 is fixedly attached to the key 10.

The user grip 120 may include a thrust butt 122, a first finger grip 123, and a second finger grip 124. The user grip 120 may conveniently define a knuckle axis 129 extending between the first finger grip 123 and the second finger grip 124. Further, the knuckle axis 129 may be normal to the axis of rotation 99 of the key 10 when the key mount 110 is fixedly attached to the key 10. For convenience of illustration, the finger split axis 119 and the knuckle axis 129 are shown here slightly separated, however it should be understood that their exact position along the axis of rotation 99 is not material.

The pivot couple 130 may be fixed to the key mount 110, and further fixed to the user grip 120. In particular, the pivot couple 130 may be fixed to the user grip 120 between the first finger grip 123 and the second finger grip 124. The pivot couple 130 is configured to rotatably couple the key mount 110 and the user grip 120 between a stowed state and a deployed state of the apparatus 100. The stowed state may be defined by the finger split axis 119 being oriented parallel with the knuckle axis 129, as shown. The deployed state may be defined by the key mount 110 and the user grip 120 being then rotated between 45 degrees and 135 degrees, but preferably a quarter turn about the axis of rotation 99 of the key 10.

Figure 2:
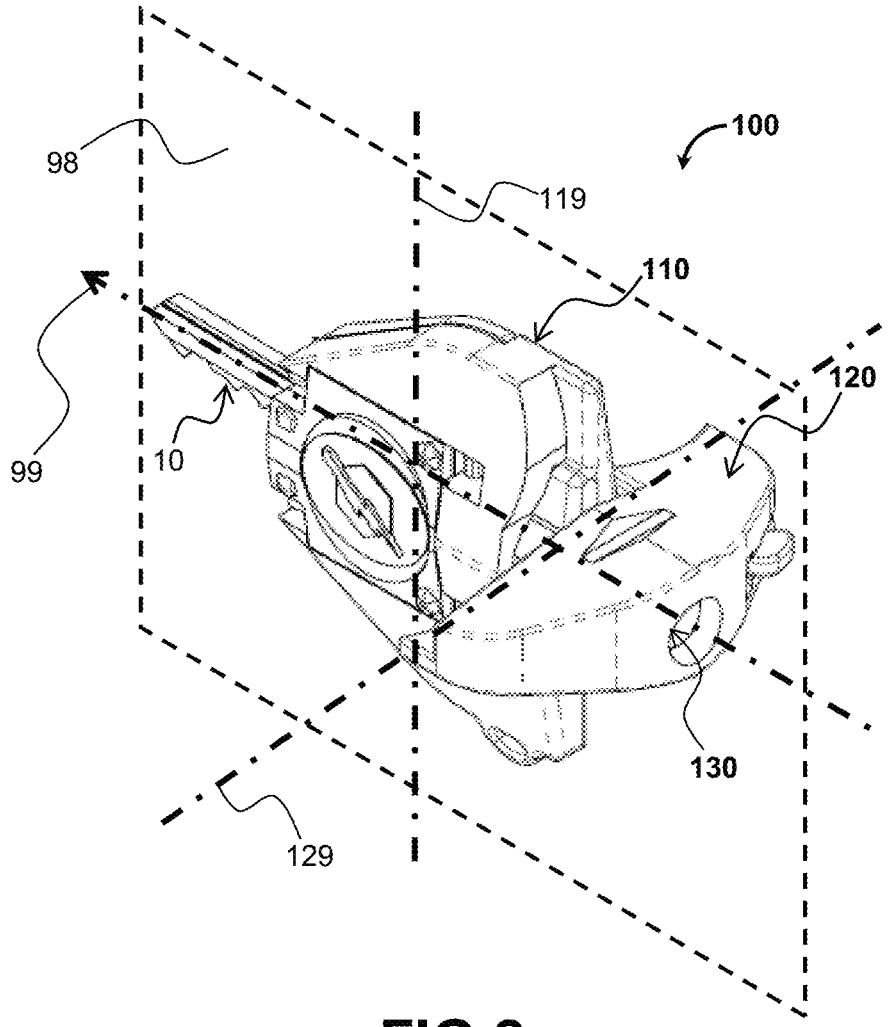
FIG. 2 is a perspective view of a self-defense key holder, according to one exemplary embodiment of the present disclosure.

FIG. 2 is a perspective view of a self-defense key holder, shown in its deployed state, according to one exemplary embodiment of the present disclosure. As above, the self-defense key holder or apparatus 100 may include the key mount 110 configured to fixedly attach to the key 10, the user grip 120, and the pivot couple 130. In this figure, the finger gripping plane 98 and the axis of rotation 99 of the key 10, as well as the finger split axis 119 and the knuckle axis 129 of the apparatus 100 are conveniently shown out of the plane of view. As shown here, the deployed state may be defined by the finger split axis 119 being oriented substantially perpendicular to the knuckle axis 129.

As discussed above, the key mount 110 is configured to fixedly attach to the key 10 and withstand thrusts as a weapon. According to one embodiment, portions of or all of the key mount 110 and the user grip 120 may be made of metal, hardened plastic, or materials of sufficient strength to support a desired strike force. As shown, portions of the key mount 110 and the user grip 120 may include bearing surfaces in contact with each other or otherwise configured to transfer impact loads directly between the key mount 110 and the user grip 120 (e.g., axial compression along the axis of rotation 99 of the key 10 between the tip 11 of the key 10 the thrust butt 122 of user grip 120). Beneficially, this may distribute or otherwise share loading transferred between the key mount 110 and the user grip 120 via the pivot couple 130 alone.

Figure 3:
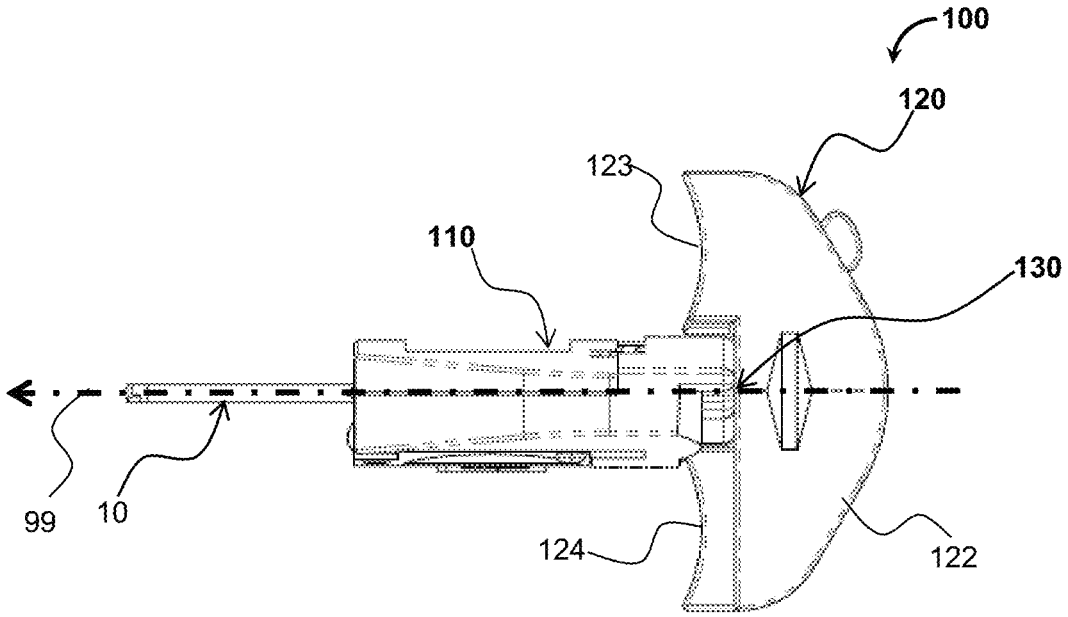
FIG. 3 is a side view of the self-defense key holder of FIG. 2, shown in its deployed state.

FIG. 3 is a side view of the self-defense key holder of FIG. 2, shown in its deployed state. As above, the apparatus 100 may include the key mount 110 configured to fixedly attach to the key 10, the user grip 120, and the pivot couple 130. Also as above, the user grip 120 may include the thrust butt 122, the first finger grip 123, and the second finger grip 124. Also as above and for reference, the key 10 has the axis of rotation 99 extending from the back 19 toward the tip 11 of the key 10.

In use, a user may acquire a firm grip of the apparatus 100 by placing the thrust butt 122 against the palm of the hand and at least one finger on each of the first finger grip 123 and the second finger grip 124. Further, the apparatus 100 may be held with key mount 110 positioned between two of the user's fingers (e.g., index and middle fingers, middle and ring finger, etc.).

As shown, the user grip 120 may include ergonomic features configured for improved gripping. For example, the thrust butt 122 may include a convex profile or otherwise be shaped to conform to the user's hand, at the back end of the user grip 120. Also for example the first finger grip 123 and the second finger grip 124 may each include concave profiles or otherwise be shaped to conform to the user's fingers, at the tip end of the user grip 120. Further, while the illustrated embodiment only includes two finger depressions, additional depressions are contemplated, in particular for the user's thumb.

Figure 4:
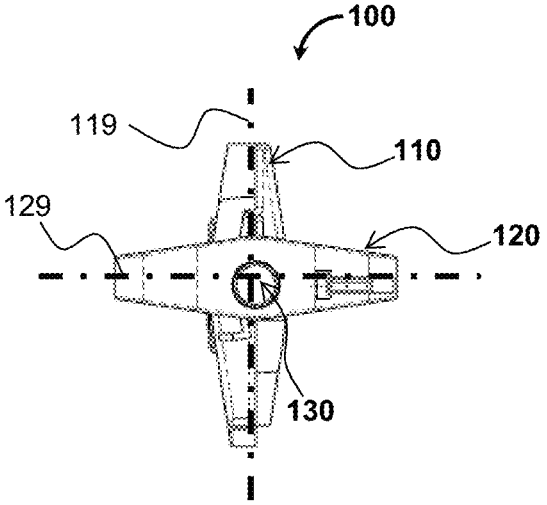
FIG. 4 is a top view of the self-defense key holder of FIG. 2, shown in its deployed state in isolation.

FIG. 4 is a top view of the self-defense key holder of FIG. 2, shown in its deployed state in isolation. As above, the apparatus 100 may include the key mount 110, the user grip 120, and the pivot couple 130, where the key mount 110 defines the finger split axis 119, and the user grip 120 defines the knuckle axis 129. As shown here, the deployed state may be defined by the finger split axis 119 being oriented substantially perpendicular to the knuckle axis 129.

According to one embodiment, one or both of the key mount 110 and the user grip 120 may have a tapered thickness. In particular, the key mount 110 and the user grip 120 may have a maximum thickness proximate the axis of rotation 99 (FIG. 2) of the key 10, and a minimum thickness distal the axis of rotation 99. It should be understood that thickness will be a dimension orthogonal to a length (i.e., measured along the axis of rotation 99 of the key 10) and a width (i.e., measured along the finger split axis 119 for the key mount 110, and along the knuckle axis 129 for the user grip 120). The tapered thickness may be linear, curved, or complex. Further, the tapered thickness may be configured to provide support strength for the key 10, for improved grip, or a combination thereof.

Figure 5:
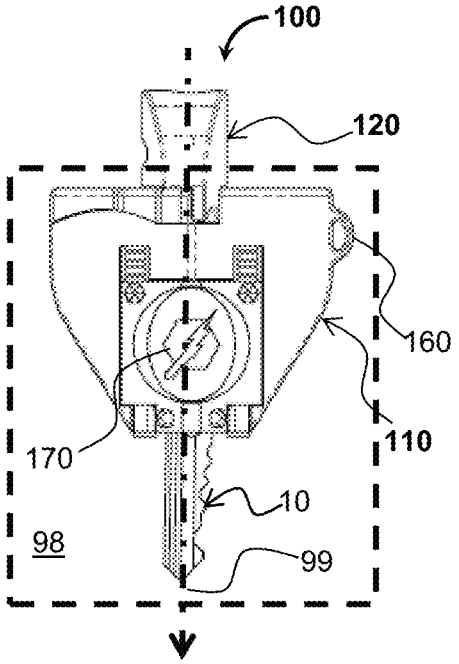
FIG. 5 is a front view of the self-defense key holder of FIG. 2, shown in its deployed state.

FIG. 5 is a front view of the self-defense key holder of FIG. 2, shown in its deployed state. As above, the apparatus 100 may include the key mount 110, the user grip 120, and the pivot couple 130, where the key 10 has the finger gripping plane 98 and the axis of rotation 99.

As shown, the key mount 110 may taper forward in plan view of the finger gripping plane 98. In particular, at least a portion of the key mount 110 may have a narrower width (i.e., measured in plane in the finger gripping plane 98 and perpendicular to the axis of rotation 99) proximate its tip end than towards its back end. The taper may extend the entire length (i.e., measured along the axis of rotation 99) or just a portion thereof. For example, here the taper extends from the tip end of the key mount 110 backwards to approximately the back 19 (FIG. 1) of the key 10.

According to one embodiment, the apparatus 100 may include an attachment junction 160. The attachment junction 160 is an attachment point and attachment means to couple the apparatus 100 to another item, for example a key chain. The attachment junction 160 may be permanently or removably fixed to the apparatus 100. For example the attachment junction 160 may include a closed loop integrated with a portion of the key mount 110, the user grip 120, and/or the pivot couple 130. Also for example, the attachment junction 160 may alternately include a removable (e.g., screw or clip in) eyelet that is coupleable to at least one of the key mount 110, the user grip 120, and the pivot couple 130.

According to one preferred embodiment, the attachment junction 160 may be fixed to the key mount 110 or otherwise adapted to isolate loads from other components of the apparatus 100, such as the pivot couple 130. Advantageously, this may provide for hanging a weighted key ring (e.g., holding many keys) from the apparatus 100 while the key is in a keyhole (e.g., a car ignition) without accelerating wear of the pivot couple 130, as it the hanging weight is isolated from the pivot couple 130.

According to one embodiment, the apparatus 100 may include a branding pad 170. The branding pad 170 may include a designated or otherwise predefined flat area configured to be printed on, to receive a label, to be etched, or to otherwise have an indicia placed on it. Preferably the branding pad 170 will be positioned on the key mount 110, and further in a centered or symmetric location (e.g., centered on the axis of rotation 99). According to one embodiment the branding pad 170 may be at least 150 square millimeters. In one preferred embodiment, the branding pad 170 may be at least 300 square millimeters. According to another embodiment, the branding pad 170 may be molded with, etched into, embossed on, or otherwise integrated into the apparatus 100. According to yet another embodiment, the branding pad 170 may be positioned on an access door of the apparatus 100. In each, the branding pad 170 may positioned on one or both of the front and back of the apparatus 100

Figure 6:
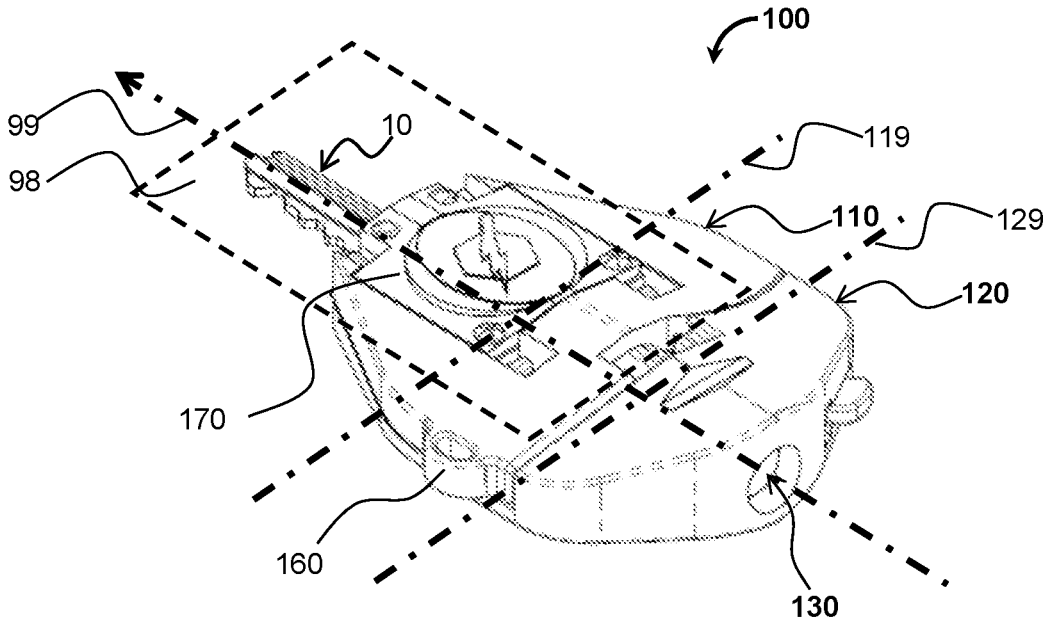
FIG. 6 is a perspective view of the self-defense key holder of FIG. 2, shown in its stowed state, according to an exemplary embodiment of the present disclosure.

FIG. 6 is a perspective view of the self-defense key holder of FIG. 2, shown in its stowed state, according to an exemplary embodiment of the present disclosure. As above, the apparatus 100 may include the key mount 110 defining the finger split axis 119, the user grip 120 defining the knuckle axis 129, and the pivot couple 130, where the key 10 has the finger gripping plane 98 and the axis of rotation 99. Further, the apparatus 100 may include the attachment junction 160 and the branding pad 170. Also as above, the stowed state may be defined by the finger split axis 119 being oriented substantially parallel with the knuckle axis 129, as shown.

According to one embodiment, the apparatus 100 may be arranged and configured to have a low profile. In particular, the pivot couple 130 may be at least partially imbedded in the key mount 110 and the user grip 120. Further, the key mount 110 and the user grip 120 may be shaped, sized, and dimensioned to come substantially flush with each other on all sides while in the stowed state, as shown. Further, the key mount 110 and the user grip 120 may have a maximum thickness (i.e., measured normal to the finger gripping plane 98) of 12 to 18 millimeters. Beneficially, in this configuration, the apparatus 100, having minimal sharp edges, may facilitate carrying in pockets and bags, for example.

Further, the apparatus 100 may be arranged and configured to have a discreet, subtle perimeter. In particular, and as shown the key mount 110 and the user grip 120 may have an outer perimeter (i.e., about an axis normal to the finger gripping plane 98) having a general appearance of a key bow (e.g., tapered tip toward tip end, wider toward back end, etc.). In this way, the apparatus 100 may discreetly have an outward appearance of an oversized key, rather than as a weapon. In addition, the perimeter may have substantially smooth, gentle transitions.

Figure 7:
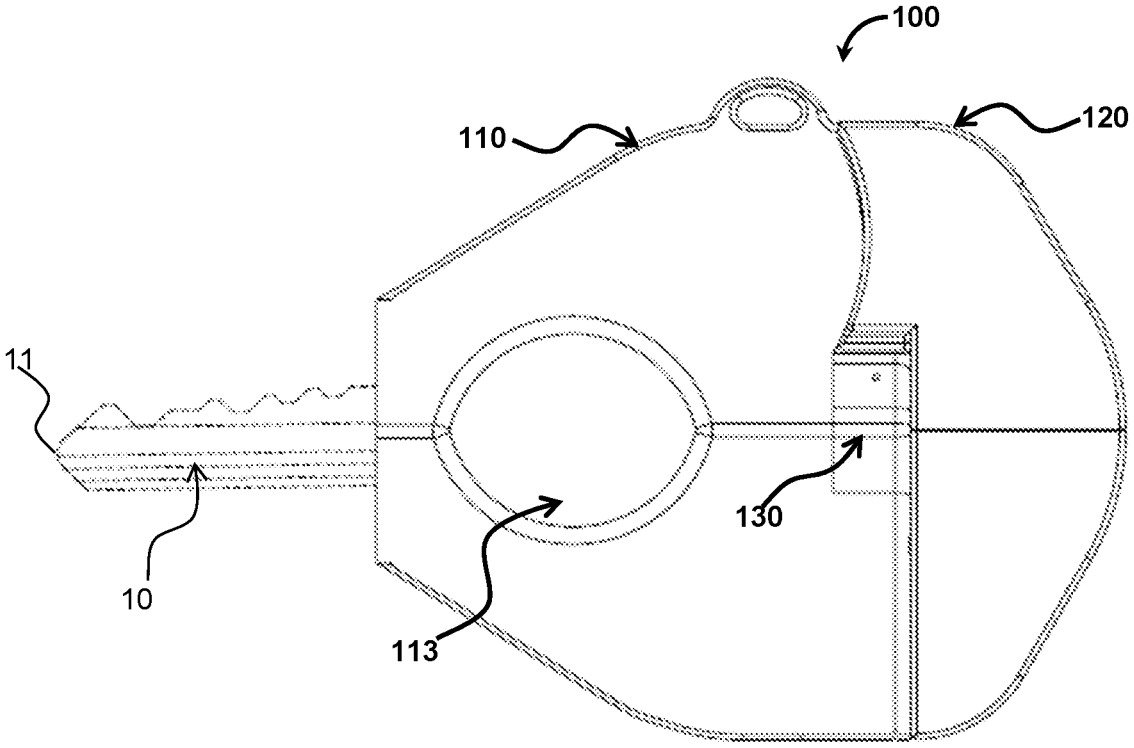
FIG. 7 is a back view of a self-defense key holder, shown in its stowed state, according to one embodiment of the disclosure.

FIG. 7 is a back view of a self-defense key holder, shown in its stowed state, according to one embodiment of the disclosure. As above, the apparatus 100 may include the key mount 110, the user grip 120, and the pivot couple 130. Also as above, the key mount 110 is configured to fixedly attach to the key 10 and withstand thrusts using the tip 11 of the key 10.

According to one embodiment, the key mount 110 may be molded onto, integrated with, or otherwise permanently fixed to with the key 10. As shown, the key mount 110 may be made of a hardened plastic or other durable material that has the key 10 at partially embedded. According to another embodiment, the key mount 110 may be integrated with the key 10. For example, both the key 10 and the key mount 110 may begin as a single blank including a locking interface for the pivot couple 130, which can be subsequently keyed for a particular lock.

According to one embodiment, the key mount 110 may include a fingertip grip 113. For example and as shown, the fingertip grip 113 may be embodied as a depression or indentation in the front or back of the key mount 110.

Figure 8:
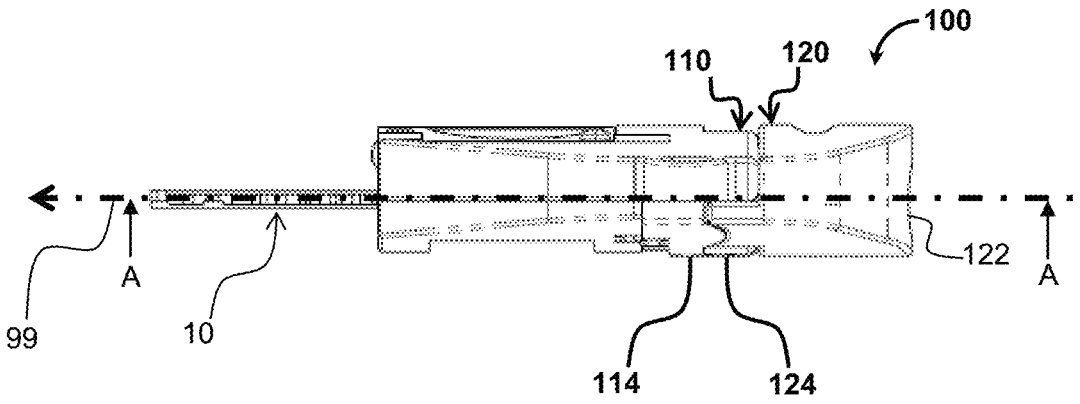
FIG. 8 is a side view of the self-defense key holder of FIG. 2, shown in its stowed state.

FIG. 8 is a side view of the self-defense key holder of FIG. 2, shown in its stowed state. As above, the apparatus 100 may include the key mount 110, the user grip 120, and the pivot couple 130 (FIG. 7), where the key 10 has the axis of rotation 99. As above, the key mount 110 and the user grip 120 may be shaped, sized, and dimensioned to come substantially flush with each other on all sides while in the stowed state. Also as above, the stowed state and the deployed state may be defined by the user grip 120 being rotated approximately 90 degrees about the axis of rotation 99.

According to one embodiment, the key mount 110 and the user grip 120 may be configured to mate or otherwise seat within each other when in the stowed state. Features on one face (i.e., front or back) may not extend to the opposite face. For example and as shown, the first finger grip 123 (not shown) and the second finger grip 124 of the user grip 120 may only have a portion or fraction of the thickness of the rest of the user grip 120 (e.g., measured at the thrust butt 122 of the user grip 120) and the key mount 110 may have mating landing pads 114. In this way the landing pads 114 of the key mount 110 may serve to prevent the user grip 120 from freely spinning (e.g., about the axis of rotation 99) in a first direction. Advantageously, the apparatus 100 may have fewer interstices or gaps when positioned in the stowed state.

Figure 9:
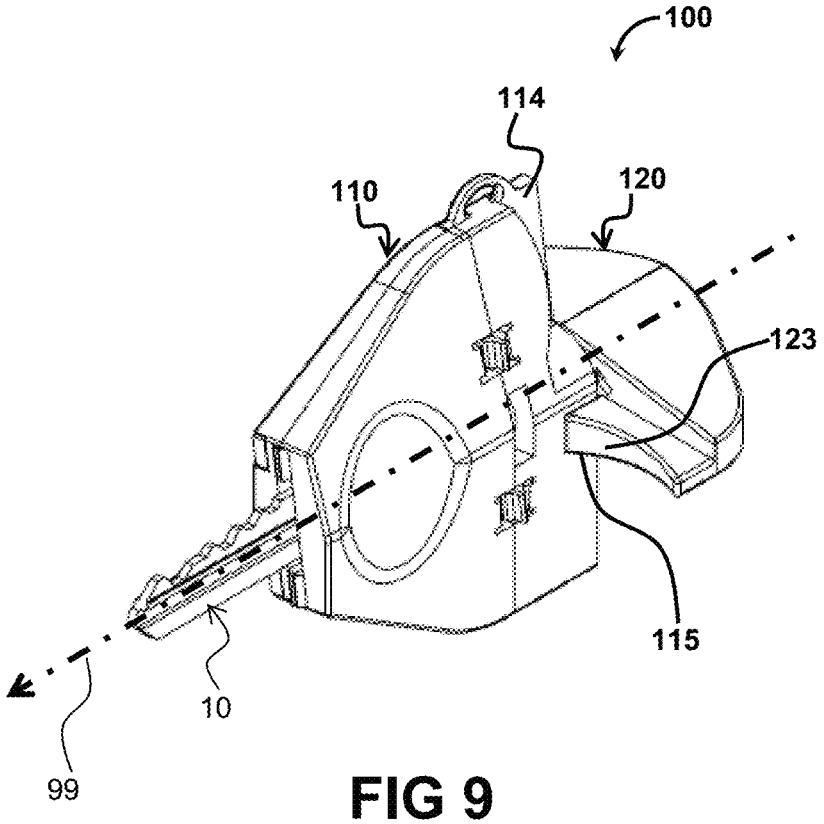
FIG. 9 is a perspective view of a self-defense key holder shown in its deployed state, according to one embodiment of the disclosure.

FIG. 9 is a perspective view of a self-defense key holder shown in its deployed state, according to one embodiment of the disclosure. As above, the apparatus 100 may include the key mount 110, the user grip 120, and the pivot couple 130 (FIG. 7), where the key 10 has the axis of rotation 99. Also, the first finger grip 123 and the second finger grip 124 (not shown) of the user grip 120 may be stepped or otherwise configured to mate flush with their respective landing pads 114 when positioned in the stowed state.

According to one embodiment the key mount 110 may include one or more reverse landing pads or deployment stops 115 configured to prevent the user grip 120 from freely spinning in an opposite direction of the stow direction. In particular, the key mount 110 may include one or more deployment stops 115 configured to prevent the user grip 120 from rotating more than ninety degrees. Here, the "opposite" or "deployment" direction is generally defined as a clockwise direction about the axis of rotation 99 of the key 10, for convenience. It should be understood that the directions of deployment and stowage may be reversed in other embodiments without departing from the spirit of the disclosure.

As illustrated, the deployment stop 115 may be embodied or otherwise include a portion of a face (i.e., front or back) of the key mount 110. Alternately, the deployment stop 115 may be embodied or otherwise include an interior portion of the key mount 110 a face (i.e., a non-face, non-edge portion), such as a lip or ledge generally set perpendicular to one face or the finger gripping plane 98 (FIG. 6).

Figure 10:
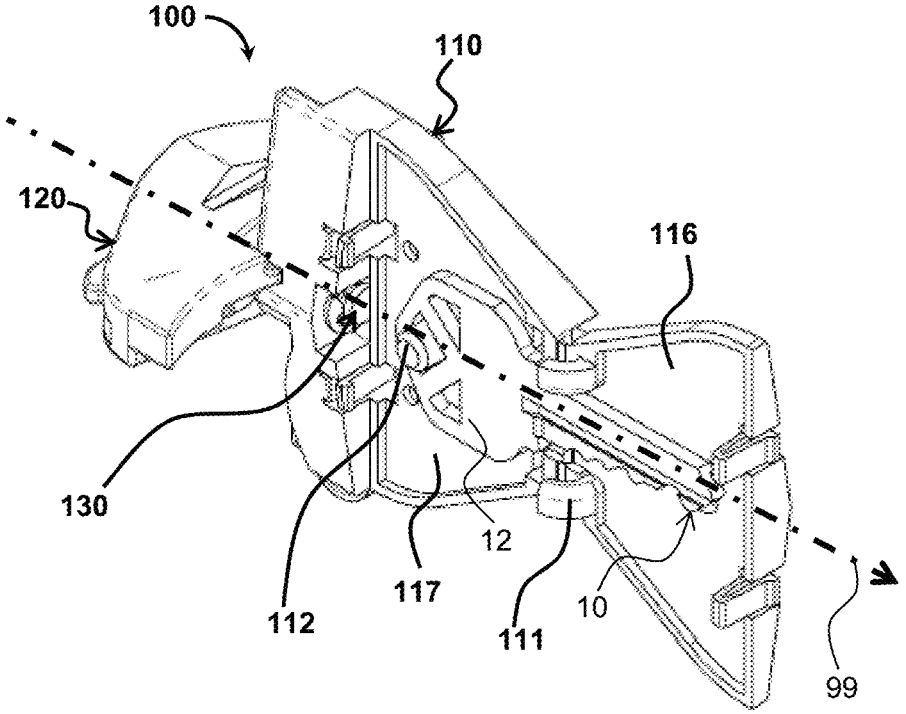
FIG. 10 is a perspective view of a self-defense key holder, shown in its deployed state with its access door open, according to an exemplary embodiment of the present disclosure.

FIG. 10 is a perspective view of a self-defense key holder, shown in its deployed state with its access door open, according to an exemplary embodiment of the present disclosure. As above, the apparatus 100 may include the key mount 110, the user grip 120, and the pivot couple 130, where the key 10 has the axis of rotation 99. As shown, the apparatus 100 may be configured to couple with or otherwise attach to the key 10 without being integrated with the key 10.

According to one embodiment, the key mount 110 may further include a key cavity 117 sized and dimensioned to receive the key 10 and an access door 116 configured to enclose and provide access to the key 10 when in the key cavity 117. According to another embodiment, the key cavity 117 may be sized and dimensioned to receive many different shapes and sizes of the key 10. Preferably, the key cavity 117 will be sized and dimensioned for the largest of an assortment of keys 10, for example, sizes may include common home, office, and car key sizes.

Figure 13:
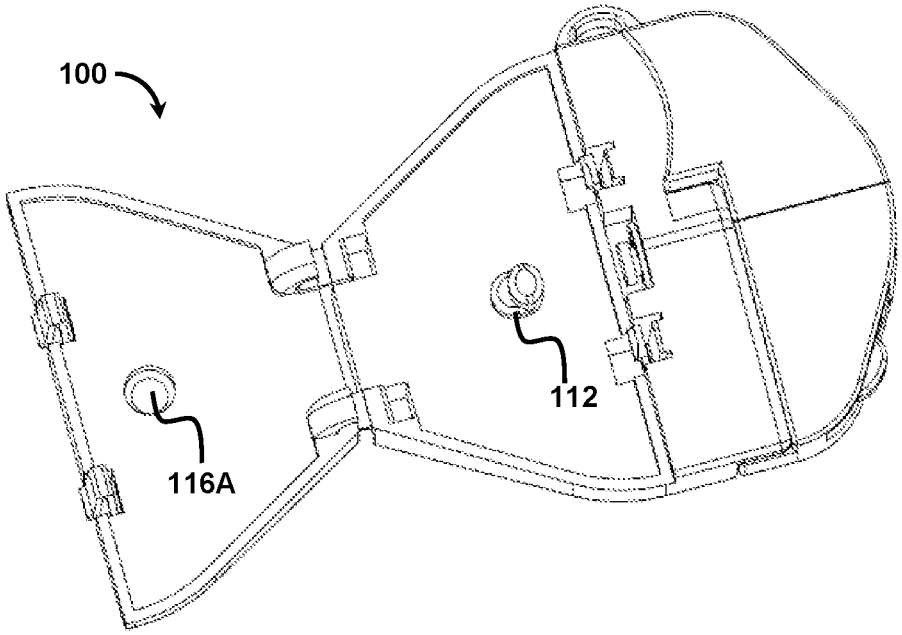
FIG. 13 is a perspective view of a self-defense key holder in isolation, shown in its stowed state with its access door open, according to an exemplary embodiment of the present disclosure.

According to one embodiment, the key mount 110 may further include a key bow mount 112 configured to couple the key 10 to the key mount 110. As shown, the key bow mount 112 may be embodied as a pin (i.e., an extrusion of any shape configured to restrict axial movement of the key 10) extending from one inner side of the key mount 110 toward the access door 116. Further, the bow mount 112 may be coupleable with the access door 116, as shown in FIG. 13 where the bow mount 112 mates with an access door receiver 116A. In this way, a passageway through the bow 12 of the key 10 (e.g., a key ring hole) may be placed about the key bow mount 112, and the access door 116 may be closed, securing the key 10 to the key mount 110, for example, against movements within the finger gripping plane 98 (FIG. 6), such as a key tip thrust.

The key mount 110 may include additional or alternate mating interfaces with the key 10, such as rails, lips, recesses, and/or other positive or negative features that secure at least a portion of a circumference of the key 10 to the key mount 110 (e.g., about the bow 12 of the key 10). Advantageously, these interfaces provide for mounting solid or unperforated keys to the key mount 110. Further, these interfaces may be configured to provide lateral support, for example, against lateral movements such as a key tip slicing movement/attack.

Further, the key mount 110 may include additional or alternate mating interfaces with the key 10 such as bow pads, an undersized key cavity 117, or other features configured to hold the opposing planar surfaces of the key 10 in compression. These interfaces may be configured to secure the key 10 to the key mount 110, for example, against forces normal to the finger gripping plane 98. Advantageously, these interfaces may provide support against bending or twisting the key 10.

Figure 11:
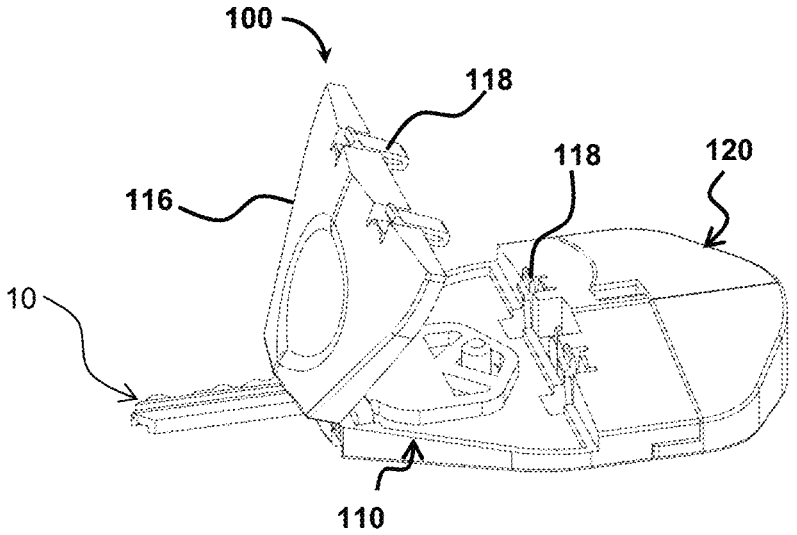
FIG. 11 is a perspective view of the self-defense key holder of FIG. 10, shown in its stowed state with its access door partially open.

FIG. 11 is a perspective view of the self-defense key holder of FIG. 10, shown in its stowed state with its access door partially open. As above, the apparatus 100 may include the key mount 110, the user grip 120, and the pivot couple 130 (FIG. 10). According to one embodiment, the access door 116 may include at least one pivot hinge 111 (FIG. 10) and at least one access door lock 118. Together, the pivot hinge 111 and the access door lock 118 may provide access to install and remove the key 10. Preferably, the access door lock 118 will be toollessly operable.

Figure 12:
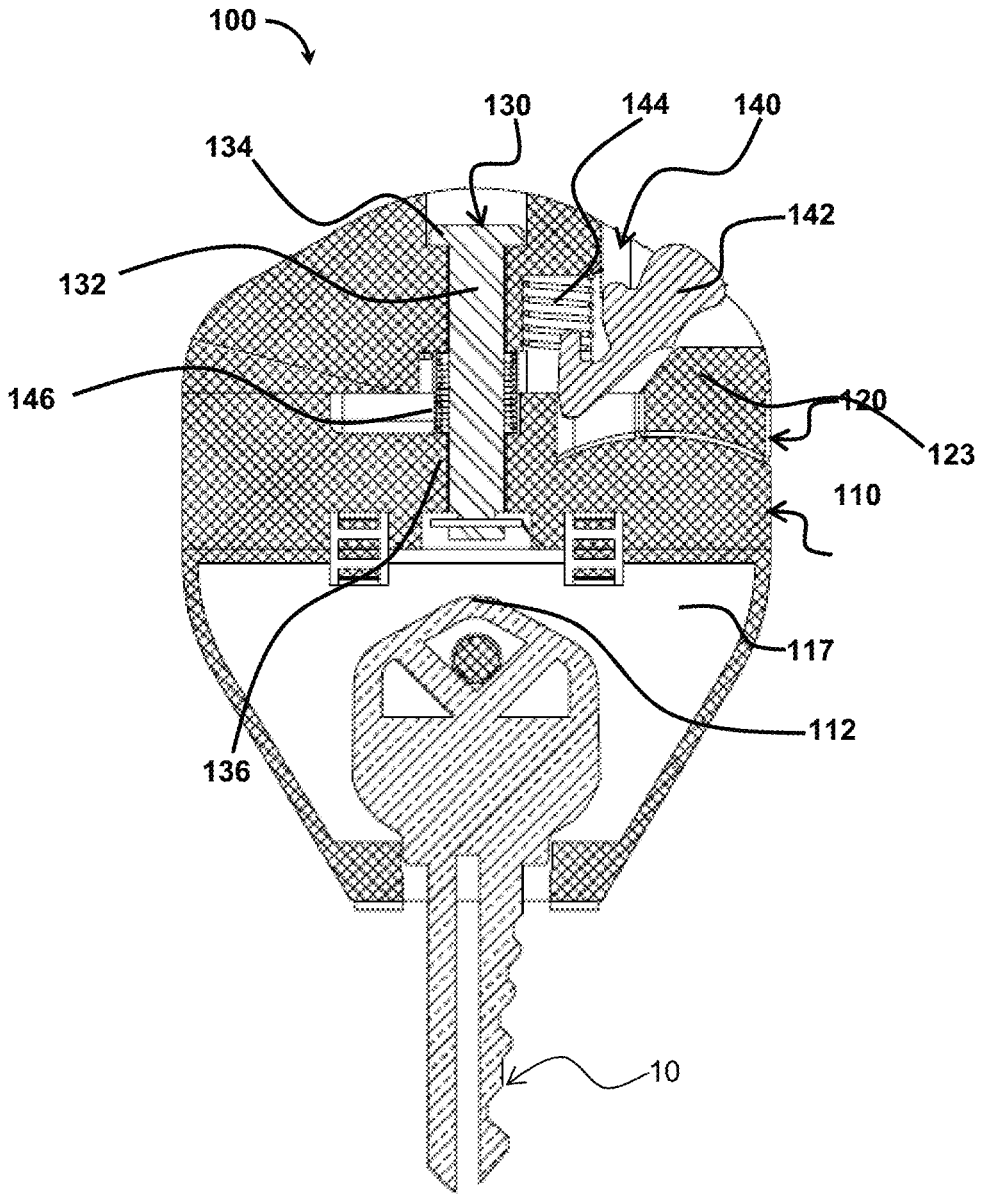
FIG. 12 is a cutaway view A-A of the self-defense key holder of FIG. 8, shown locked in its stowed state, according to an exemplary embodiment of the present disclosure.

FIG. 12 is a cutaway view A-A of the self-defense key holder of FIG. 8, shown locked in its stowed state, according to an exemplary embodiment of the present disclosure. As above, the apparatus 100 may include the key mount 110 including the key bow mount 112 and the key cavity 117, the user grip 120 including the first finger grip 123 and the second finger grip 124 (FIG. 8), and the pivot couple 130. In addition, the apparatus 100 may include a deployment mechanism 140 configured to deploy the apparatus 100 to its deployed state, and/or stow the apparatus 100 to its stowed state.

As shown in this embodiment, generally, the key mount 110 connects to a spring operated pin, which is connected to the user grip 120. The pin is secured in place by a notch that is released by a button. When the button is pushed the pin is released therefore rotating the user grip 120 at a 90 degree angle, locking it in place until button is pushed in and disengages the lock.

More particularly, the deployment mechanism 140 may include a trigger such as catch 142 and catch spring 144, and an energizer such as torsion spring 146. The deployment mechanism 140 may be embedded or otherwise affixed to at least one of the key mount 110, the user grip 120, and the pivot couple 130. For example, the catch 142 may be slidably coupled to the user grip 120 and retractable therein when placed under release pressure sufficient to resist the catch spring 144, thus activating/releasing the torsion spring 146 of the deployment mechanism 140 (e.g., here, opposite the tip direction). It should be understood that many other triggers and energizers are contemplated, including but not limited to electronic means. Further, the deployment mechanism 140 may include features to rapidly and/or easily deploy the apparatus 100 to its deployed state. Similarly, the deployment mechanism 140 may include features to inhibit and/or make it harder to inadvertently stow the apparatus 100 to its stowed state.

As above, the pivot couple 130 may be fixed to the key mount 110 and the user grip 120 between the first finger grip 123 and the second finger grip 124. Likewise, the pivot couple 130 may be configured to rotatably couple the key mount 110 and the user grip 120 between a stowed state and a deployed state of the apparatus 100. According to one embodiment, the pivot couple 130 may be embedded (fully or partially) in at least of one of the key mount 110 and the user grip 120, and alternately may be external (fully or partially) to at least of one of the key mount 110 and the user grip 120 or otherwise accessible to a user.

According to one embodiment, the pivot couple 130 may be configured as a spring-loaded pin. In particular, the pivot couple 130 may include a shaft 132, a head 134 fixed to one end of the shaft 132, and a retainer 136 affixable to the other end of the shaft 132. In this way, the pivot couple 130 may be conveniently and efficiently inserted into one of the key mount 110 and the user grip 120 (here, the user grip 120), into the other, and secured via the retainer 136 (here a retention ring). Further, the shaft 132 may be coaxial with the torsion spring 146 such that both share a common void or cavity, and where the torsion spring 146 is landed against both the key mount 110 and the user grip 120 the shaft 132 may be configured to support the torsion spring 146. In this embodiment, the torsion spring 146 may be arranged as either a deployment energizer, a stowage energizer, or both (e.g., selectably). According to one embodiment, the shaft 132 and the head 134 may be formed of a single material, such as steel, hard/strong polymer, composite, etc.

Figure 14:
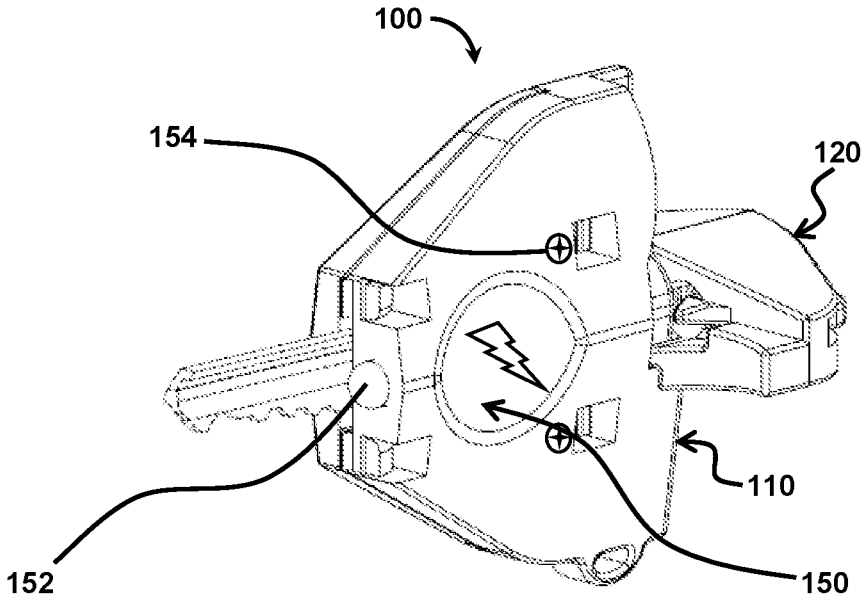
FIG. 14 is a perspective view of a self-defense key holder, according to an exemplary embodiment of the present disclosure.

FIG. 14 is a perspective view of a self-defense key holder, according to an exemplary embodiment of the present disclosure. As above, the apparatus 100 may include the key mount 110, the user grip 120, and the pivot couple 130 (FIG. 12). In addition, the apparatus 100 may include a light assembly 150.

The light assembly 150 may be configured to light a key hole, light a walkway, and/or light a face of an attacker (potentially in a blinding manner). The light assembly 150 may include a light 152 and associated electronics and energy storage (not shown) and may be adapted to couple to the key mount 110 of the apparatus 100, for example, with one or more fasteners 154. The one or more fasteners 154 may be configured to provide a persistent couple (e.g., screws, clips, etc.) or may be readily separable (e.g., magnets, detents, etc.). For example, the one or more fasteners 154 may provide for the light assembly 150 to be separable from the apparatus 100 and independently usable.

According to one embodiment, the light assembly 150 may include a user interface configured to manually operate the light 152. For example, user interface may be integrated with the fingertip grip 113 (FIG. 7) or the branding pad 170 (FIG. 5), or may be embodied as dedicated UI (e.g., switch, button, etc.).

According to another embodiment, the light 152 may be automatically operated, for example, by deploying the apparatus 100 from its stowed state to its deployed state, or by decoupling the light assembly 150 the light assembly 150 from its base (e.g., from the key mount 110).

Benefits of the present disclosure may include providing an ergonomic grip that protects users hand from potential injury over typical method of holding a key. Generally, a protective case that securely fits over a commonly used key, and utilizes a spring operated grip is provided, which when released, provides a user with a safe method to hold a key by the use of a comfortable grip therefore preventing them cutting their own hand. Further, the disclosure provides a compact design to easily carry with other keys. In addition, a user may advantageously have the practical use of flashlight for finding keyhole plus shining in attacker's eyes.

The above description of the various embodiments is provided to enable a person of ordinary skill in the art to make or use the subject matter of the disclosure. Various modifications to the embodiments will be readily apparent to those skilled in the art, and the generic principles defined herein may be applied to other variations without departing from the spirit or the scope of this disclosure. Thus, it is to be understood that the disclosure is not intended to be limited to the examples and designs described herein, which merely represent a presently preferred implementation of the disclosure, but that the disclosure is to be accorded the widest scope consistent with the principles and novel features disclosed herein. It is to be further understood that the scope of the present disclosure fully encompasses other embodiments that may become obvious to those skilled in the art. For example, the principles of the present disclosure may be applied to other high cost items that are not vehicles but are powered, such as air conditioners for structures, or to more mobile items such as entertainment systems, solar power systems, and the like.

The invention claimed is:

1. An apparatus for holding a key, the key defining a finger gripping plane and an operational axis of rotation within the finger gripping plane, the key having a forward tip and a back opposite the tip, relative the axis of rotation, the apparatus comprising:

a key mount configured to fixedly attach to the key and to withstand thrusts into a person using the tip of the key without releasing the key, the key mount defining a finger split axis that is within the finger gripping plane and normal to the axis of rotation of the key when the key mount is fixedly attached to the key;

a user grip including a first finger grip, a second finger grip, and a thrust butt, and configured to be held by a user between at least two fingers and a palm of the user, where a first finger and a second finger of the at least two fingers of the user are pressed backwards against the first finger grip and the second finger grip, respectively, and the palm of the user is pressed forward against the thrust butt, respectively, the user grip defining a knuckle axis extending between the first finger grip and the second finger grip, the knuckle axis normal to the axis of rotation of the key when the key mount is fixedly attached to the key; and a pivot couple fixed to the key mount, and further fixed to the user grip between the first finger grip and the second finger grip, the pivot couple configured to rotatably couple the key mount and the user grip between a stowed state and a deployed state of the apparatus, said stowed state defined by the finger split axis being oriented substantially parallel with the knuckle axis, said deployed state defined by the finger split axis being oriented substantially perpendicular to the knuckle axis.

2. The apparatus of claim 1, wherein the key mount includes a key cavity sized and dimensioned to receive the key, an access door configured to enclose and provide access to the key when in the key cavity, and a key bow mount configured to couple the key to the key mount, the key cavity sized and dimensioned to receive a plurality of different key shapes and key sizes.

3. The apparatus of claim 2, wherein the key bow mount further includes a pin extending from one inner side of the key mount toward the access door, and through the finger gripping plane when the key mount is fixedly attached to the key.

4. The apparatus of claim 3, further comprising:

a branding pad including a predefined area of at least 150 square millimeters that is configured have an indicia placed on it;

a state lock configured to releasably secure the apparatus in the stowed state;

a deployment mechanism configured to automatically deploy the apparatus to its deployed state when the state lock is unlocked; and a light assembly adapted to couple to the key mount, the light assembly including a light, associated electronics, and an energy storage; and wherein the key mount has a front side and a back side separated by the finger gripping plane of the key, and the key mount includes a fingertip grip including a surface depression on at least one of the front side or the back side of the key mount, said surface depression being positioned, sized, and dimensioned for a thumb of the user;

wherein the first finger grip and the second finger grip each include an ergonometric concave curve adapted for one of the at least two fingers of the user, and the thrust butt includes an ergonometric convex curve adapted for the palm of the user;

wherein the key mount and the user grip are made of plastic;

wherein the key mount and the user grip together form an outer perimeter having an appearance of a key bow, such that the apparatus has an outward appearance of an oversized key when the key mount is fixedly attached to the key;

wherein the key mount and the user grip are shaped, sized, and dimensioned to come substantially flush with each other on all sides while in the stowed state, and have a maximum thickness of 18 millimeters;

wherein the key mount includes a deployment stop configured to prevent the user grip from rotating more than ninety degrees in an opposite direction of the stow direction; and wherein the light assembly is removable from the key mount and operable when separated.

5. The apparatus of claim 2, wherein the key bow mount further includes at least one key circumference mating interface configured to secure at least a portion of a circumference of the key.

6. The apparatus of claim 1, wherein the key mount is permanently fixed to the key.

7. The apparatus of claim 1, wherein the key mount has a front side and a back side separated by the finger gripping plane of the key, and the key mount includes a fingertip grip including a surface depression on at least one of the front side or the back side of the key mount, said surface depression being positioned, sized, and dimensioned for a thumb of the user.

8. The apparatus of claim 1, wherein the first finger grip and the second finger grip each include an ergonometric concave curve adapted for one of the at least two fingers of the user, and the thrust butt includes an ergonometric convex curve adapted for the palm of the user.

9. The apparatus of claim 1, wherein the key mount and the user grip are made of plastic.

10. The apparatus of claim 1, further comprising a branding pad including a predefined area of at least 150 square millimeters that is configured have an indicia placed on it.

11. The apparatus of claim 1, wherein the key mount and the user grip together form an outer perimeter having an appearance of a key bow, such that the apparatus has an outward appearance of an oversized key when the key mount is fixedly attached to the key.

12. The apparatus of claim 1, wherein the key mount and the user grip are shaped, sized, and dimensioned to come substantially flush with each other on all sides while in the stowed state, and have a maximum thickness of 18 millimeters.

* * * * *